US006388611B1

(12) United States Patent
Dillman

(10) Patent No.: US 6,388,611 B1
(45) Date of Patent: May 14, 2002

(54) METHOD AND SYSTEM FOR DYNAMIC SURVEILLANCE OF A REMOTE OBJECT USING GPS

(75) Inventor: David J. Dillman, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/817,516

(22) Filed: Mar. 26, 2001

(51) Int. Cl.[7] ..... H04B 7/185
(52) U.S. Cl. ..... 342/357.06; 342/357.17
(58) Field of Search ..... 342/357.01, 357.06, 342/357.17; 701/213, 215

(56) References Cited

U.S. PATENT DOCUMENTS 5,204,731 A * 4/1993 Tanaka et al. ..... 356/1
5,233,357 A * 8/1993 Ingensand et al. ..... 342/352
5,671,160 A * 9/1997 Julian ..... 364/559
5,672,820 A * 9/1997 Rossi et al. ..... 73/178 R

* cited by examiner

*Primary Examiner*—Dao Phan
(74) *Attorney, Agent, or Firm*—Nathan O. Jensen; Kyle Eppele

(57) ABSTRACT

A system and method for dynamic electronic surveillance comprising an imaging system having an angular measurement device, such as a seeker, in combination with a GPS receiver and a microprocessor which are used to compute a latitude and longitude of a remotely sensed position after it has been surveyed from a plurality of known measuring positions.

20 Claims, 3 Drawing Sheets

METHOD AND SYSTEM FOR DYNAMIC SURVEILLANCE OF A REMOTE OBJECT USING GPS

FIELD OF THE INVENTION

The present invention generally relates to electronic surveillance, and more particularly relates to use of directional image sensors in electronic surveillance, and even more particularly relates to methods and systems for dynamic surveillance of a remote object using directional sensors.

BACKGROUND OF THE INVENTION

In recent years, military mission planners typically have utilized a tremendous amount of intelligence information in carrying out their duties. Modern satellite imagery has proven to be an invaluable component of this intelligence information. However, it is often difficult, dangerous, and/or expensive to obtain very current and detailed information regarding dynamic rear enemy positions. Surveillance aircraft can be used, but at the risk of human life. Drones or other un-piloted surveillance aircraft have been used, but at great expense.

Missile-launched directional image sensors have gained widespread acceptance. One common usage of such directional image sensors has been in conjunction with seekers used for missile guidance. Typically, in these systems, an electronic sensor is manipulated to sense an area in front of a missile; the system is used to survey the area and to lock on and track a target. The target may be stationary or mobile, such as an enemy tank, mobile missile launcher, etc. In such systems, some information is often provided, via a telemetry data link, to a remotely located weapons officer who uses the information to guide the missile.

While these missile-launched seeker systems have proven utility in the battlefield, they do have some drawbacks. First of all, they are often used for very limited purposes. For example, seeker systems are widely used with glide bombs and other missiles to provide precision guidance only in areas very near the ultimate target. Another example is where a single seeker system is used to point a single gun or group of linked guns to lock on a mobile target, such as an enemy tank in tank-to-tank warfare. Secondly, these seeker systems typically do not generate surveillance information for use other than the targeting of the missile or other mobile munitions co-located with the seeker system.

Consequently, there exists a need for improved methods and systems for assisting mission planners and others with dynamic surveillance in an efficient manner.

SUMMARY OF THE INVENTION

It is an object of the present invention to provide a system and method for dynamic surveillance in an efficient manner.

It is a feature of the present invention to utilize a GPS receiver in conjunction with a seeker to dynamically determine a location of a remotely surveyed position.

It is another feature of the present invention to include a system and software to compute a latitude and longitude coordinate for a remotely surveyed position.

It is an advantage of the present invention to achieve improved efficiency in electronic surveillance of dynamic targets.

It is another feature of the present invention to utilize an optical sighting device having angular measurement capabilities.

It is another advantage of the present invention to provide the ability to use human sight-aided equipment which is capable of generating position information of a remote location.

The present invention is an apparatus and method for dynamic surveillance designed to satisfy the aforementioned needs, provide the previously stated objects, include the above-listed features, and achieve the already articulated advantages. The present invention is carried out in a "wasted utility-less" manner in a sense that the lack of use of additional inherent utility of seekers and GPS receivers in mobile military applications has been greatly reduced.

Accordingly, the present invention is a system and method for dynamic surveillance, which uses a GPS receiver and an angularly adjustable image system.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
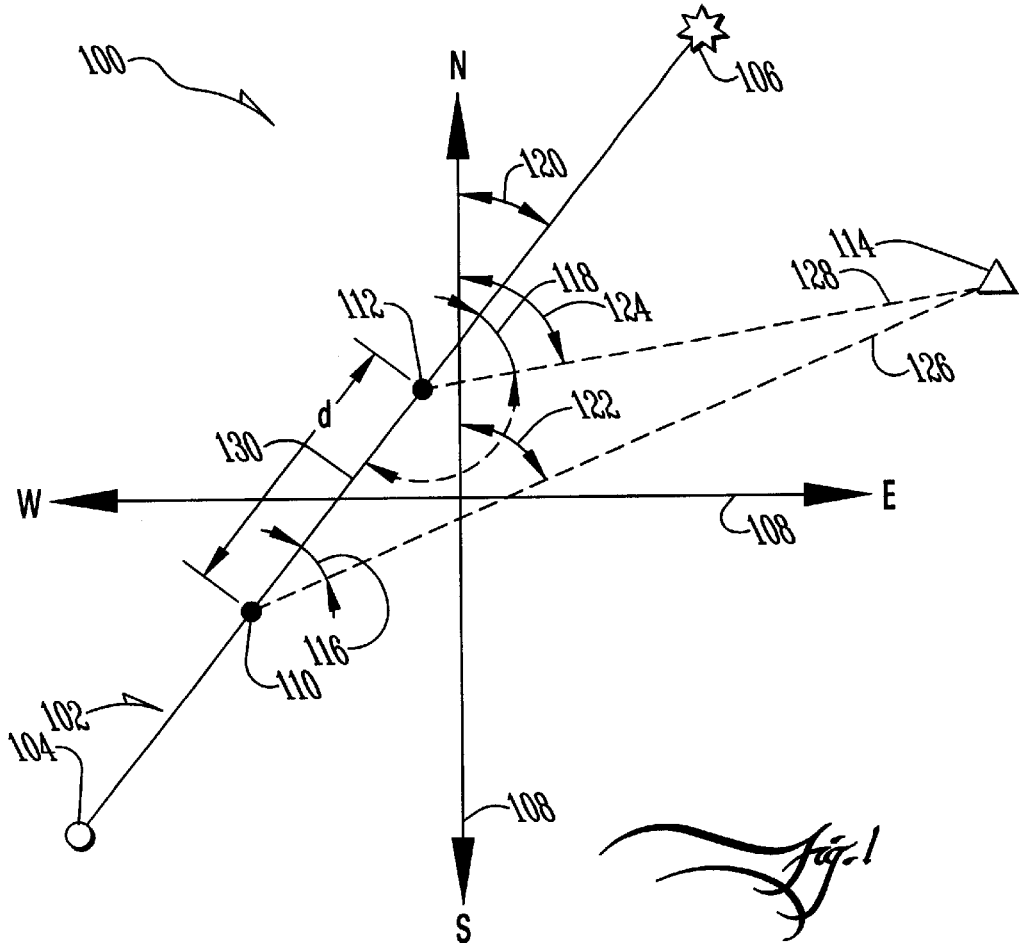
FIG. 1 is a simplified schematic depiction of a process of the present invention.

Now referring to the drawings wherein like numerals refer to like matter throughout, and more specifically referring to FIG. 1, there is shown a simplified graphic depiction of components of a method of the present invention, generally designated 100. There is shown a flight path 102, which can represent a flight path line of a missile (cruise or ballistic), or a general path of travel for any mobile object, including a foot soldier. The details of each point on the flight path 102 are not important except that it has at least two points: first angular measurement location 110, and second angular measurement location 112 therein which are known. Flight path 102 begins at missile launch site 104 and ends at missile target 106. Of course, when the present invention is employed on a mobile platform other than a missile, other descriptive terms would be more suitable. Flight path 102 is shown in relation to compass rose reference lines 108. Flight path 102 is also shown to include first angular measurement location 110 and second angular measurement location 112. These locations are known because they represent positions or locations where measurements are taken and GPS data is obtained. Since the GPS derived latitude and longitude coordinates of first angular measurement location 110 and second angular measurement location 112 are known, the separation distance "d" can be calculated. At first angular measurement location 110, a first angle 116 is determined via use of angular measurement instrument 206 (FIG. 2); the angular measurement is taken as extending from the flight path 102. However, it should be understood that other points, lines, etc. of reference could be used as well. Often, the angle between the flight path 102 and a North reference line would be expressed as the heading of the missile. The first angular measurement location-bearing angle 122 of the surveyed target at first angular measurement location 110 would be the angle between the North reference line and first bearing line 126. First angle 116 could be expressed as bearing minus heading or first angular measurement location bearing angle 122 minus missile heading 120. Other reference lines could be used as well; it is believed that compass rose reference lines 108 are preferred. Similarly, second angle 118 could be expressed as second angular measurement location bearing angle 124 minus missile heading 120. A triangle is created by first bearing line 126, second bearing line 128, and known leg 130. Using well-known techniques of Euclidean geometry, lengths of either first bearing line 126 or second bearing line 128 can be calculated. Once either of these lengths is known, and the locations of first angular measurement location 110 and second angular measurement location 112 are determined by the GPS receiver 202 (FIG. 2), a latitude and longitude coordinate can be determined for surveyed target 114. It should be understood that latitude and longitude may be expressed in various units of measure. It should also be understood that any other geo-reference systems could be used instead of latitude and longitude, which is believed now to be preferred.

Figure 2:
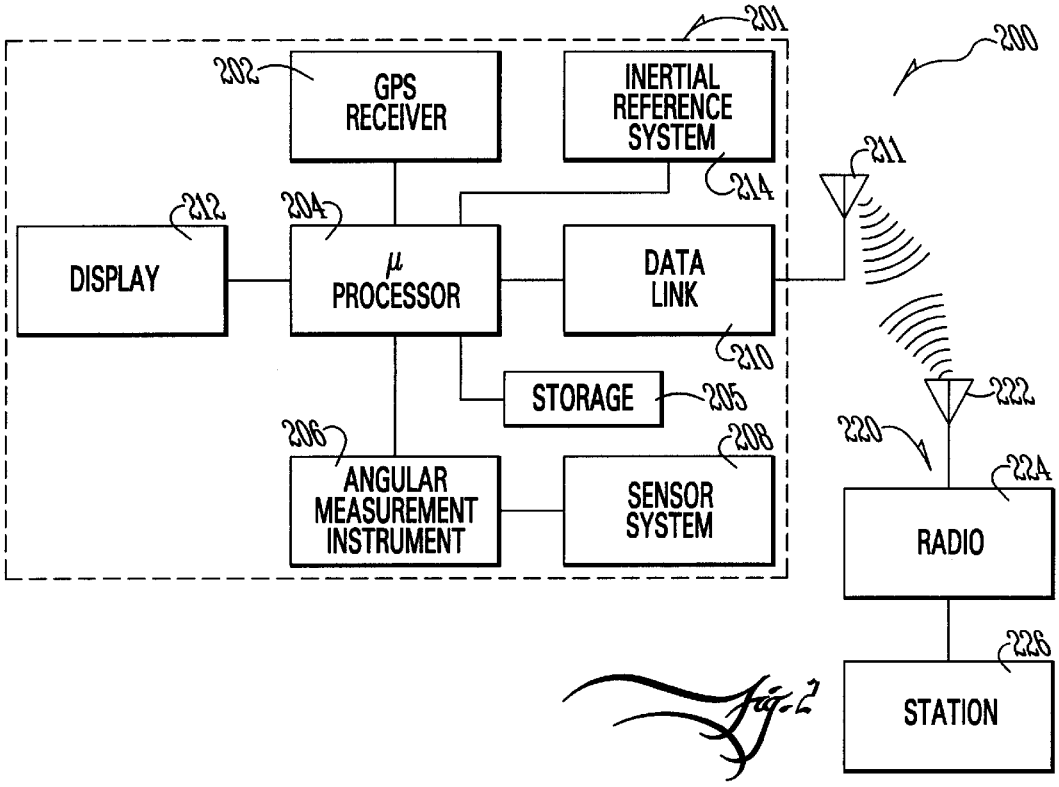
FIG. 2 is a simplified block diagram of the apparatus of the present invention.
Figure 3:
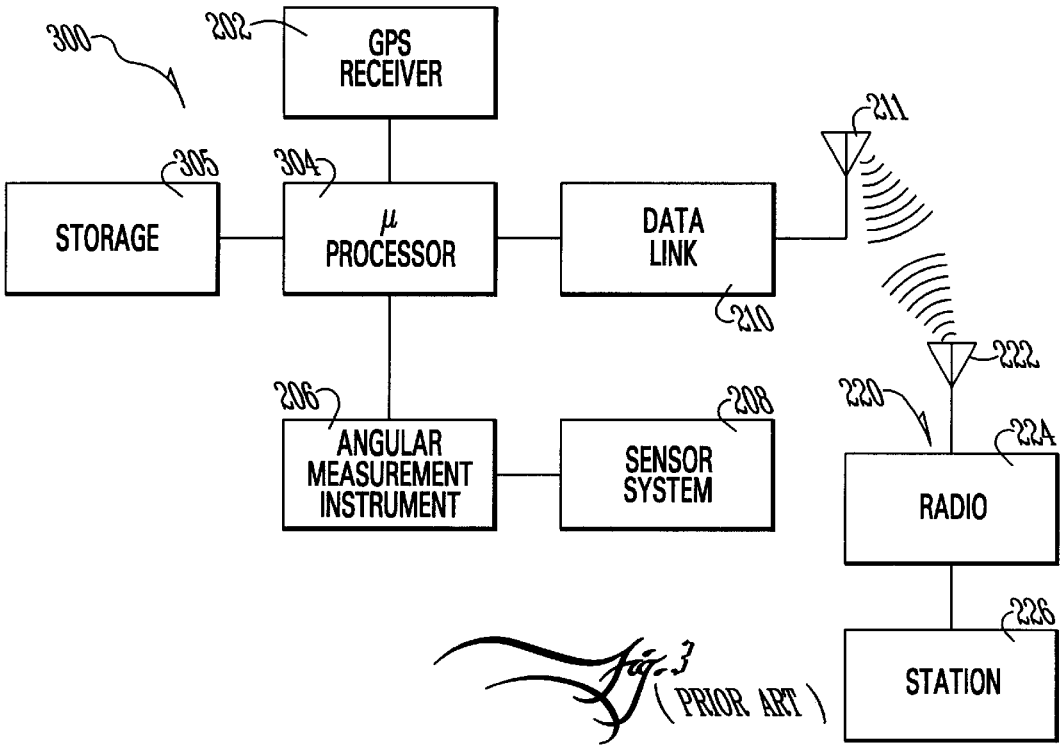
Fig. 3 (PRIOR ART)
FIG. 3 is a simplified block diagram view of the prior art.

A more detailed understanding of the present invention can be achieved by now referring to FIG. 2, which shows a mobile platform, generally designated 200, including a GPS receiver 202, which could be any type of position system, such as Glonass, Loran, or others. Mobile platform 200 can be any mobile platform. When it is a missile, it will be coupled to a propulsion system (not shown, but well known in the art) to carry the missile to its intended target. Microprocessor 204 is shown to represent a computing platform upon which the remote position determining software of the present invention would run. It should be understood that microprocessor 204 need not be a separate, independent, or distinct microprocessor. In fact, microprocessor 204 could be a shared processor with GPS receiver 202 or angular measurement instrument 206 or sensor system 208. Microprocessor 204 is coupled to a data or program storage location 205, which, among other things, stores the remote position-determining software of the present invention. This remote position-determining software may be written in any appropriate software language which is suitable for use with the microprocessor 204. With the aid of this description and common knowledge of programming techniques, a person skilled in the art would be able to generate software to perform the functions shown and described in FIG. 1. Angular measurement instrument 206 can be any instrument which is capable of generating an angular measurement signal which relates to an angular orientation of surveyed target 114 with respect to the flight path 102 or mobile platform 200. Where the present invention is deployed on a missile, the angular measurement instrument 206 could be part of a seeker (similar to well-known prior art seekers) used to track targets, etc. or other sensor system 208. Additionally, when the present invention is deployed in a missile application, it would be necessary to include data link 210, which could be used to transmit back to a weapons officer or mission planner the location of enemy targets surveyed by the missile. In prior art remotely guided missile systems, such as shown in FIG. 3, it has been well known to provide real-time video images to a weapons officer station 226, which is coupled via radio 224 and antenna 222 to the antenna 211. Once the missile is very near the target, the weapons officer uses the video to guide the missile or glide bomb to its exact target location. FIG. 3 shows much the same apparatus as FIG. 2, the present invention. One salient difference is the microprocessor 304 is not functioning the same as microprocessor 204 of FIG. 2, and it does not operate on the same software. Microprocessor 304 does not perform the calculation as described and shown in FIG. 1, and consequently, it also does not assist in the delivery of lat/lon location tagged images as is done by the apparatus of FIG. 2. Storage 305 does not contain the remote position-determining software of the present invention.

It is also envisioned the present invention could enjoy utility with handheld surveillance equipment used by a foot soldier, hiker, hunter, or other person. A handheld device could be constructed which includes an angular measurement instrument 206 which records an orientation of the device with respect to a reference. This device would be optical in nature, so that a human eye is used to align the device with a surveyed target 114. A GPS receiver 202 would be coupled thereto, as described and shown elsewhere in this description. An inertial reference system 214, such as one including at least one gyroscope, an accelerometer or electronic compass, or other rotation sensor, could be included as well. (Note: a missile application may or may not have an inertial reference system 214 to augment the information from the GPS receiver 202.) The operation of the handheld device would be similar, and it would follow the same basic reverse triangulation technique of the present invention. In one preferred embodiment, the handheld device would have a button or switch which when depressed, would initiate the process of the present invention. Assuming the device were in motion, the device would continue to its operation of making numerous calculations from differing positions (determined by GPS receiver 202); then, upon release of the button, the device would calculate and display, via display device 212, the latitude and longitude of the surveyed target 114. (Note: in missile applications, there generally would not be any need for a display on the missile.) This assumes that the device was optically aligned with the surveyed target 114 both when the button is pressed and when it is released. This creates the potential for an extremely user-friendly device, which has countless uses, such as search and rescue, forest fire spotting, law enforcement, and others. These devices could be handheld, or they could be mounted in a vehicle or an aircraft, and they may be combined with other optical equipment, such as binoculars, cameras, laser range finders, spotting scopes, etc.

In operation, the apparatus and method of the present invention as described in FIGS. 1–2, could function as follows: In a missile application, the missile is launched from missile launch site 104; its sensor system 208 is activated either immediately or once it is located over an area to be surveyed. Images of the area are transmitted back to the weapons officer station 226 via data link 210 and intermediate equipment. The images transmitted during the transit, or non-final approach phase, are preferably of enemy armor, munitions, or other facilities. Instead of sending back just raw video images, these images are now recognized, using known image recognition techniques and a database available in flight. Once an object is recognized as an object to be surveyed, then the process described in FIG. 1 is performed. A lat/lon of this remotely located object is then associated with an image of the object, and both are transmitted to the weapons officer station 226 or other mission planner. The image may be a text-augmented video image with a textual tag giving lat/lon displayed on or about the image. The lat/lon information of the object may also be transmitted by data link 210 without an image, and with some predetermined identifier or classification of the type of object. Several objects may be encountered during the transit phase of the missile flight, and each can be surveyed and reported back to the weapons officer station 226 or other mission planner. The above-described operation is carried out, at least in part, by the remote position software which is stored in storage location 205. This remote position-determining software could include the entire software necessary to survey and fully report on several remote objects during the transit phase of the missile flight. Once the missile reaches its target area, the normal final targeting and remote guidance functions of the present invention (which are similar to those for prior art system 300) resume, and the missile is precisely guided to its target. Back at the weapons officer station 226, the information from the missile is gathered, along with other similar missiles, and new targeting of future missiles is performed with the information provided by the lat/lon tagged images of the present invention. Very little new hardware or software is required to implement the new missile surveillance system of the present invention.

Throughout this description, reference is made to a seeker and to a microprocessor, because it is believed that the beneficial aspects of the present invention would be most readily apparent when used in connection with such devices; however, it should be understood that the present invention is not intended to be so limited and should be hereby construed to include other non-seeker and non-microprocessor devices as well.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. The form herein described is merely a preferred exemplary embodiment thereof.

I claim:

1. A surveying apparatus comprising:

means for determining a geo-reference coordinate for a position;

directional image sensor system, having an angular measurement capability; and, remote position-determining software which includes instructions to compute a latitude and longitude of a surveyed target at a first remote location, via the following steps:

obtaining a first angular measurement to said surveyed target with respect to an orientation line associated with said surveying apparatus; said first angular measurement being taken at a first angular measurement location;

associating a unique geo-reference coordinate with said first angular measurement location;

obtaining a second angular measurement to said surveyed target with respect to an orientation line associated with said surveying apparatus; said second angular measurement being taken at a second angular measurement location which is different from said first angular measurement location;

associating a unique geo-reference coordinate with said second angular measurement location;

determining a geographic separation relationship between said first angular measurement location and said second angular measurement location; and, using said geographic separation relationship and said first and said second angular measurements to compute a unique geo-reference coordinate for said surveyed target at said first remote location.

2. An apparatus of claim 1 wherein said means for determining a geo-reference coordinate is a GPS receiver.

3. An apparatus of claim 2 wherein said directional image sensor system is an optical system configured and adapted for use in conjunction with a human eye.

4. An apparatus of claim 2 wherein said directional sensor system is an electronic sensor which is not adapted and configured to use a human eye to assist in directional adjustment of said directional sensor system toward said surveyed target.

5. An apparatus of claim 4 further including means for propulsion of said surveying apparatus from said first angular measurement location to said second angular measurement location.

6. An apparatus of claim 5 wherein said means for propulsion is a missile.

7. An apparatus of claim 2 wherein said directional image sensor system includes a seeker.

8. An apparatus of claim 2 wherein said orientation line is a flight path.

9. An apparatus of claim 3 wherein said optical system is a handheld system.

10. An apparatus of claim 3 wherein said optical system includes a camera.

11. An apparatus of claim 1 further comprising a data link for providing said geo-reference coordinate for said surveyed target to a second remote location which is different from said first remote location and said first and said second angular measurement locations.

12. An apparatus of claim 1 wherein said directional image sensor system includes an infrared sensor.

13. An apparatus of claim 1 wherein said directional image sensor system does not provide information regarding a range characteristic with respect to a separation of said surveyed target and said first angular measurement location.

14. An apparatus of claim 11 wherein said directional image sensor system does not provide information regarding a range characteristic with respect to a separation of said surveyed target and said first angular measurement location.

15. An apparatus of claim 14 further including means for propulsion of said surveying apparatus from said first angular measurement location to said second angular measurement location.

16. An apparatus of claim 15 wherein said directional image sensor system includes a seeker.

17. An apparatus of claim 16 wherein said means for propulsion is a missile.

18. A method of determining a location of a surveyed position from a mobile platform comprising the steps of:

taking, at a first angular measurement location, a first angular measurement with respect to a line from said mobile platform to said surveyed position;

using a GPS receiver for associating a unique geo-reference coordinate with said first angular measurement location;

moving said mobile platform to a second angular measurement location;

using a GPS receiver for associating a unique geo-reference coordinate with said second angular measurement location;

taking, at said second angular measurement location, a second angular measurement with respect to a line from said mobile platform to said surveyed position;

using Euclidean geometry techniques to calculate a precise location of said surveyed position with respect to either of said first angular measurement location and said second angular measurement location;

generating a unique geo-reference coordinate for said surveyed position.

19. A method of claim 18 wherein said step of taking, at a first angular measurement location, a first angular measurement uses a seeker.

20. A missile comprising:

means for propulsion of a payload to a remote location;

a GPS receiver, for generating latitude and longitude coordinates;

an electronic infrared imaging sensor, including a seeker, for locating, locking on, and tracking a remote object;

said electronic infrared imaging sensor being of a type which does not compute, based upon a timed return of an emitted signal from said missile, a range characteristic between said missile and said remote object;

software which includes instructions to compute a latitude and longitude of a surveyed target at a first remote location; via the following steps:

obtaining, with the aid of said seeker, a first angular measurement to said surveyed target with respect to flight path line associated with said missile; said first angular measurement being taken at a first angular measurement location;

associating a unique latitude and longitude coordinate with said first angular measurement location;

obtaining a second angular measurement to said surveyed target with respect to said flight path of said missile; said second angular measurement being taken at a second angular measurement location, which is different from said first angular measurement location;

associating a unique latitude and longitude coordinate with said second angular measurement location;

determining a geographic separation relationship between said first angular measurement location and said second angular measurement location; and, using said geographic separation relationship and said first and said second angular measurements to compute, using techniques of Euclidean geometry, a unique latitude and longitude coordinates for said surveyed target at said first remote location;

software means for associating an image with said unique latitude and longitude coordinates of said surveyed target;

a data link communication system disposed on said missile for transmitting images relating to scenes along said flight path and for reporting said unique latitude and longitude coordinates of said surveyed target to a second remote location where said unique latitude and longitude information coordinates together with an associated image are used for purposes other than delivery of munitions coupled to said missile; and, software means for manipulating said electronic imaging sensor for mapping areas about said flight path of said missile and for surveying a plurality of survey targets disposed in said areas.

* * * * *